United States Patent [19]

Abratis et al.

[11] Patent Number: 5,058,659

[45] Date of Patent: Oct. 22, 1991

[54] PROCESS FOR THE PRODUCTION OF STEEL HAVING A VARYING CHEMICAL COMPOSITION IN THE CROSS-SECTION

[75] Inventors: Horst Abratis, Hagen; Hans-Joachim Selenz, Bad Iburg; Friedrich Höfer, Sulzbach-Rosenberg, all of Fed. Rep. of Germany

[73] Assignee: Klöckner Stahl GmbH, Duisburg, Fed. Rep. of Germany

[21] Appl. No.: 420,307

[22] Filed: Oct. 12, 1989

[30] Foreign Application Priority Data

Oct. 12, 1988 [DE] Fed. Rep. of Germany ..... 3834666

[51] Int. Cl.[5] ..... B22D 11/10

[52] U.S. Cl. ..... 164/473; 420/87

[58] Field of Search ..... 164/473; 420/87; 428/610, 683

[56] References Cited

U.S. PATENT DOCUMENTS

| | | | |
|---|---|---|---|
| 3,326,647 | 6/1967 | Holtzmann et al. | 428/610 |
| 4,047,556 | 9/1977 | Obinata et al. | 164/473 |
| 4,238,230 | 12/1980 | Bucher et al. | 164/473 |
| 4,504,554 | 3/1985 | Yoshioka et al. | 428/683 |
| 4,524,819 | 6/1985 | Yoshimura | 164/473 |

FOREIGN PATENT DOCUMENTS

| | | | |
|---|---|---|---|
| 55-070451 | 5/1980 | Japan | 164/473 |
| 57-054528 | 11/1982 | Japan | 164/459 |
| 62-142053 | 6/1987 | Japan | 164/473 |
| 01-062254 | 3/1989 | Japan | 164/473 |
| 450640 | 4/1968 | Switzerland . | |
| 1162891 | 8/1969 | United Kingdom . | |
| 1520937 | 8/1978 | United Kingdom . | |

*Primary Examiner*—Richard K. Seidel
*Assistant Examiner*—Rex E. Pelto
*Attorney, Agent, or Firm*—Watson, Cole, Grindle & Watson

[57] ABSTRACT

A process is provided for producing a steel bloom having a varying chemical composition in the cross-section. First, a flow of molten steel is directed into a casting chill form via a pouring pipe. Next, an alloy wire (e.g., sulphur foil, iron sulfite and other sulphur compounds) is introduced to the chill form. This alloy wire is melted in the molten steel from the upper surface of the molten steel to a maximum depth corresponding to the lower edge of the pouring pipe. The resulting steel bloom exhibits a substantially constant decreasing chemical composition in the cross-section from the outer to the center of the bloom and is easily regulated and reproduced.

8 Claims, 1 Drawing Sheet

PROCESS FOR THE PRODUCTION OF STEEL HAVING A VARYING CHEMICAL COMPOSITION IN THE CROSS-SECTION

BACKGROUND OF THE INVENTION

1. Technical Field of the Invention

The present invention relates to a process for the continuous casting of steel which produces a steel bloom exhibiting a varying chemical composition in its cross-section.

2. Discussion of the Related Art

Several processes are known which attempt to produce steel blooms with unequal chemical analyses in the cross-section via a continuous casting process. For example, Swiss patent document 450 640 describes a process for producing continuous steel blooms whose outer areas and center have different properties. The blooms are cast in at least two streams simultaneously in a common casting process with optimum combination and without contraction errors. It is also common in the industry to introduce alloys such as aluminum in wire form into the continuous casting chill form.

However, these prior continuous casting processes fail to Produce steel blooms with unequal distribution of the added alloys through the cross-section of the bloom reliably or in a reproducible manner.

It is therefore an object of the present invention to create a continuous casting process for the continuous production of steel blooms which have a clearly higher concentration of the alloy added in the continuous casting chill form in their superficial surface areas than in their center area.

It is a further object of the present invention to accomplish the foregoing object predictably and with regularity.

Additional objects and advantages will become apparent from the drawing and specification which follow.

SUMMARY OF THE INVENTION

The present invention achieves this object by the following process. First, a flow of molten steel is directed into a casting chill form via a pouring pipe. Next, an alloy wire (e.g., sulphur foil, iron sulfite, and other sulphur compounds) is introduced to the chill form. This alloy wire is melted in the molten steel from the upper surface of the molten steel to a maximum depth corresponding to the lower edge of the immersion pouring pipe. Accordingly, a steel bloom is produced which exhibits a varying chemical composite in the cross-section.

DETAILED DESCRIPTION OF THE INVENTION

Figure 1A:
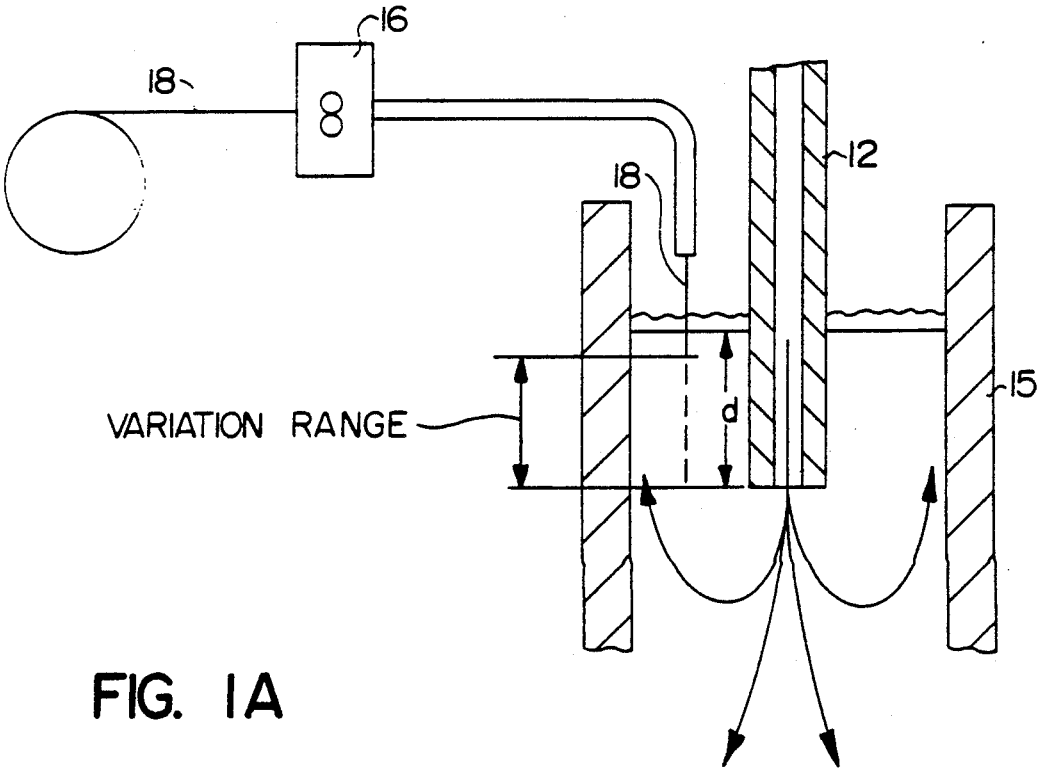
FIG. 1*a* is a schematic representation of the process according to the present invention.
Figure 1B:
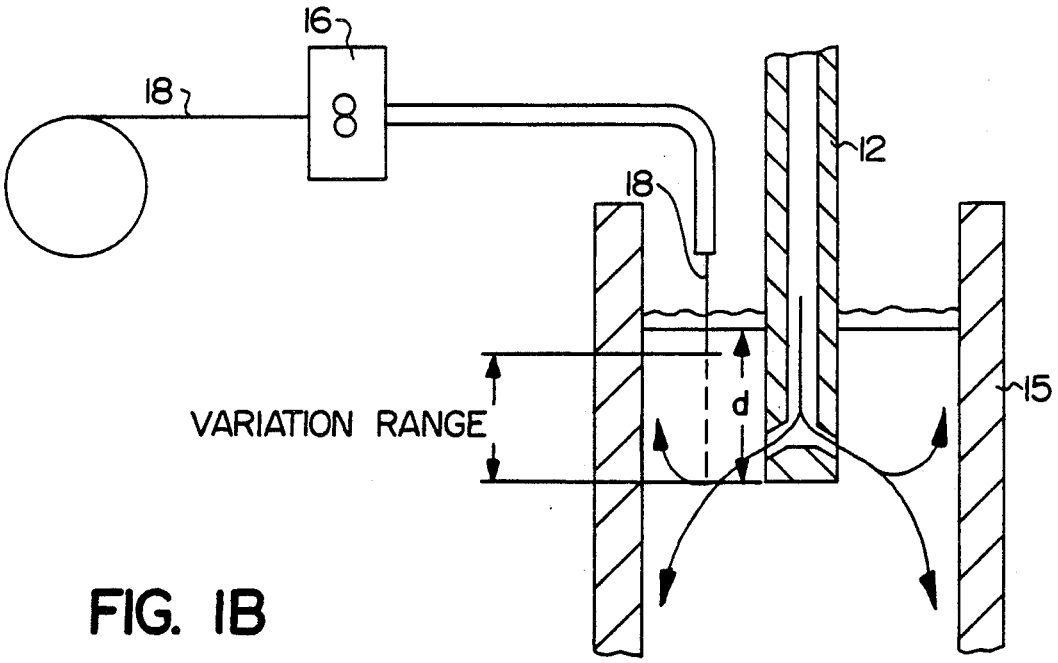
FIG. 1*b* is a schematic representation of another embodiment of the process according to the present invention.

Referring to FIG. 1*a*, the process according to the present invention will now be explained. Molten steel is directed from an intermediate container such as a tundish [not shown] via an immersion pipe 12. Gate-type valve joints [not shown] regulate the flow and allow it to be introduced axially relative to pipe 12 into water-cooled continuous casting chill forms 15. As seen in FIG. 1*b*, the immersion pipe 12 may be configured to introduce molten steel laterally relative to itself, thereby resulting in a different introduction flow than that of the pipe shown in FIG. 1*a*.

A coiling device 16 supplies alloy wire 18 to the chill form 15 continuously at a constant rate. The introduced wire 18 is melted in the molten steel from the upper surface of the steel to a maximum depth d corresponding to the lower edge of the pipe 12. The resulting bloom exhibits excellent cross-sectional variance, as discussed more fully below.

The process of the invention can be used for many alloys which are employed in steel production and which are available in suitable form, e.g., wire or strips 18. In the sense of the present invention, the term "wire" is intended to comprise even rectangular or merely geometric cross-sectional forms, particularly those with a clearly differentiated height/width ratio, e.g., strips. The alloy can be employed singularly or alloyed with other materials such as various iron alloys. In addition, alloys of powder or pellet form and embedded in a metal cast such as small iron or steel tubes can be introduced into the continuous casting chill form. For example, coal, vanadium, chromium, boron can be employed purely, in alloys, and/or as mixtures.

The use of the inventive process has proven particularly advantageous during the addition of sulphur in a continuous casting chill form. The sulphur can, for example, be delivered into the molten mass in the form of pure sulphur, so-called "sulphur foil", as wire in an iron coating, or it can be employed as iron sulphite, FeS.

A significant feature of the inventive process consists in controlling the speed with which the alloy wire 18 is introduced into the continuous casting chill form 15 in such a way that the alloy dissolves near the surface of the molten steel in the continuous casting chill form 15 at an alloy immersion depth d. This depth d can vary as shown within the labelled variation range extending from just below the surface of the molten steel to a predetermined depth.

Surprisingly, the present invention results in a 2 to 10 times higher concentration of sulphur in the outer area than in the center area which could be regulated depending on the amount of sulphur added in the outer area of the steel bloom produced in the casting. In addition, the sulphur content of the outer area is between 0.02 and 0.08%. For example, a six-bloom cogged ingot casting was produced by the process of the present invention having a cross-section of 200×240 mm. The casting had sulphur concentrations of 0.035 to 0.042% underneath the casting surface in an outer layer of approximately 20 mm width in these ingots, while the remainder of the cross-section had a sulphur concentration of only 0.009%. This material, in the steel product CK-45, for example, proves itself especially advantageous for cutting.

This regulated, unforeseeable change in concentration across the bloom's cross-section may be related to the pouring ratios in the continuous casting chill form. When the alloy is quickly dissolved near the surface of the molten mass, the alloy components in the continuous casting chill form possibly flow reliably through the stream of circulation in the upper portion of the chill form across the meniscus into the outer areas and are not caught by the strong stream of molten metal pouring out of the pouring pipe and channel.

The invention will now be more explicitly explained using a non-limiting example.

Approximately 20 t steel at a temperature of 1545° C. and a compound of 0.39% C, 0.004% S, 0.02% P, 0.022% Al, 0.34% Si, 0.68% Mn were located in an intermediate container. From this intermediate container six streams were directed via pouring pipes 12 and valves into the corresponding chill forms 15 of the cogged ingot. The cross-section of the ingot was 200×240 mm. As is usual, the pouring speed was 0.8 m/min.

Each continuous casting chill form 15 has a coiling device 16 for alloy wire 18 from which iron-coated sulphur foil was fed into each chill form 15 at a rate of about 66.7 g/min to maximum depth d. An average sulphur concentration in the bloom of about 0.025% was calculated from the ratios between the poured stream and the added sulphur.

The cross-sectional analysis of the finished bloom, however, resulted in approximately the following distribution: in the 10 mm surface, i.e., in the superficial or outer layer, 0.042% sulphur was determined. In the outer intermediate area underneath it, which has an average layer size of 10 mm, sulphur concentrations up to 0.025% were determined. The low-sulphur center area with an average cross-section of about 200 or 160 mm, on the other hand, showed a sulphur concentration of only 0.010% S.

It is within the spirit of the invention to adapt the process to the individual continuous casting methods with different operating requirements while maintaining the process's essential feature, i.e., the controlled, relatively limited immersion depth of the alloy wire until it has dissolved. This includes, for example, employing alloy materials other than sulphur with the goal of achieving an unequal concentration distribution across the poured bloom cross-section.

Although the invention has been described with reference to preferred embodiments, it will be understood that other modifications and changes can be made without departing from the scope and spirit of the invention as defined in the following claims.

We claim:

1. Process for continuously casting steel to produce a bloom exhibiting varying chemical composition in its cross-section, comprising the steps of:

directing a flow of molten steel into a casting chill form via a pouring pipe;

introducing an alloy wire to the casting chill form into the surface of the molten steel from above; and completely melting the introduced alloy wire in the molten steel from the upper surface of the molten steel in the form to a maximum depth corresponding to the lower edge of the pouring pipe, whereby a higher concentration of the alloy is formed in the outer zone of the bloom as compared to the center area and a substantially constant gradual decrease in alloy concentration is exhibited from the outer surface of the bloom to the bloom's center area.

2. The process according to claim 1, wherein said introducing step comprises introducing an alloy wire selected from the group consisting of sulphur foil and iron sulfite.

3. The process according to claim 1, wherein said introducing step comprises introducing a sulphur compound wire.

4. The process according to claim 1, wherein said introducing step is performed continuously.

5. The process according to claim 1, wherein said introducing step is performed at a constant rate.

6. Process for continuously casting steel to produce a bloom exhibiting varying chemical composition in its cross-section, comprising the steps of:

directing a flow of molten steel into a casting chill form via a pouring pipe;

introducing an alloy wire to the casting chill form into the surface of the molten steel from above; and completely melting the introduced alloy wire in the molten steel from the upper surface of the molten steel in the form to a maximum depth corresponding to the lower edge of the pouring pipe, and controlling the speed by which the alloy wire is introduced with respect to the flow of molten steel into the chill form, whereby a higher concentration of the alloy is formed in the outer zone of the bloom as compared to the center area and a substantially constant gradual decrease in alloy concentration is exhibited from the outer surface of the bloom to the bloom's center area.

7. The process according to claim 6, wherein said introducing step comprises introducing an alloy wire selected from the group consisting of sulphur foil and iron sulfite.

8. The process according to claim 6, wherein said introducing step comprises introducing a sulphur compound wire.

* * * * *